US005174451A

United States Patent [19]

Niven

[11] Patent Number: 5,174,451

[45] Date of Patent: Dec. 29, 1992

[54] CONTAINER FOR DISPENSING PILLS, TABLETS AND CAPSULES

[75] Inventor: Norman Niven, Cheadle Hulme, United Kingdom

[73] Assignee: Surgichem Limited, Stockport, England

[21] Appl. No.: 721,624

[22] PCT Filed: Jan. 12, 1990

[86] PCT No.: PCT/GB90/00052

§ 371 Date: Jul. 19, 1991

§ 102(e) Date: Jul. 19, 1991

[87] PCT Pub. No.: WO90/07921

PCT Pub. Date: Jul. 26, 1990

[51] Int. Cl.[5] ..... A61J 1/00

[52] U.S. Cl. ..... 206/534; 206/538

[58] Field of Search ..... 206/528, 534, 534.1, 206/538, 539, 438

[56] References Cited

U.S. PATENT DOCUMENTS

| | | | |
|---|---|---|---|
| 3,225,913 | 12/1965 | Lee | 206/534 |
| 3,393,794 | 7/1968 | Borin | 206/539 |
| 3,537,422 | 11/1970 | Moe | 206/534 |
| 3,618,559 | 11/1971 | Moe | 206/538 |
| 4,038,937 | 8/1977 | Moe | 206/538 |
| 4,039,080 | 8/1977 | Cappuccilli | 206/538 |
| 4,062,445 | 12/1977 | Moe | 206/538 |
| 4,473,156 | 9/1984 | Martin | 206/534 |
| 4,593,819 | 6/1986 | Will | 206/534 |
| 4,872,559 | 10/1989 | Schoon | 206/534 |

*Primary Examiner*—Jimmy G. Foster

*Attorney, Agent, or Firm*—Nies, Kurz, Bergert & Tamburro

[57] ABSTRACT

A container for dispensing pills, tablets or capsules and comprising a box (10) having hinged lid (16). The box (10) contains a removable compartmented tray (21) having, in the example illustrated, seven rows each of six compartments (22) for containing items to be dispensed, and representing the days of the week and six periods during each day. The compartments (22) may be viewed through a like number of windows (17) in the hinged lid (16), each row being occluded by a transparent sliding shutter (18) which may be slid open progressively to permit the contents of each compartment (22) to be discharged. The entire container may be filled without removing the tray (21) from the box (10), and information such as medicines and patient details, is visible through windows (28) on the underside of the box (10) and through a window (29) on one side wall (12) thereof.

11 Claims, 2 Drawing Sheets

CONTAINER FOR DISPENSING PILLS, TABLETS AND CAPSULES

This invention concerns a container for dispensing pills, tablets and capsules.

It is known to provide such a device which includes a tray having a plurality of compartments to contain the pills, tablets and capsules to be taken at predetermined intervals, the tray being removably located within a drawer slidable within an outer container having a partially transparent front face so that the pills within the compartments may be viewed without opening the drawer. In the front face there are a number of sliding shutters which may be withdrawn selectively and progressively for the discharge of the contents of individual compartments. Also on the front face there is provided indicia representing, for example, the days of the week and periods during each day.

On a rear face of the container further information is visible to identify the patient and the medicines to be taken together with such further information as may be required including, for example, the name of the administering doctor, the dosage and the number of tablets to be taken in each day.

This kind of device is for use by individual patients within the community or in hospitals and other establishments where the dosage of medicines for patients may be made up, say, once a week from a central dispensary.

There is a disadvantage in the known type of container for this purpose in that it is necessary to separate the drawer containing the compartmented tray, in order to fill the compartments, and this can lead to trays being returned to the wrong containers with the consequent danger of administering drugs incorrectly to patients.

An object of the present invention is to provide a device of this general kind which is more convenient and safer in use, is more universally adaptable to different situations, and which contains a greater amount of information for use by the dispensing staff and/or by the patient.

According to the present invention there is provided a container for dispensing pills, tablets or capsules or combinations thereof, comprising a box, means visible on the box for displaying information appertaining to the intended contents, a compartmented tray within the box and having a plurality of rows of compartments to contain the pills or tablets to be taken at predetermined intervals, characterised in that the box includes a hinged or removable lid, in that the lid includes a plurality of windows each coinciding in superimposed relationship with one or more of said compartments with the lid closed, and shutters to occlude the windows which may be opened selectively to permit the contents of one or more compartments to be discharged without opening the lid, and in that all of the compartments of the tray are exposed for filling within the box when the lid is opened without separation of the tray from the information displaying means.

An embodiment of the invention will now be described, by way of example only, with reference to the accompanying drawings in which.

Figure 1:
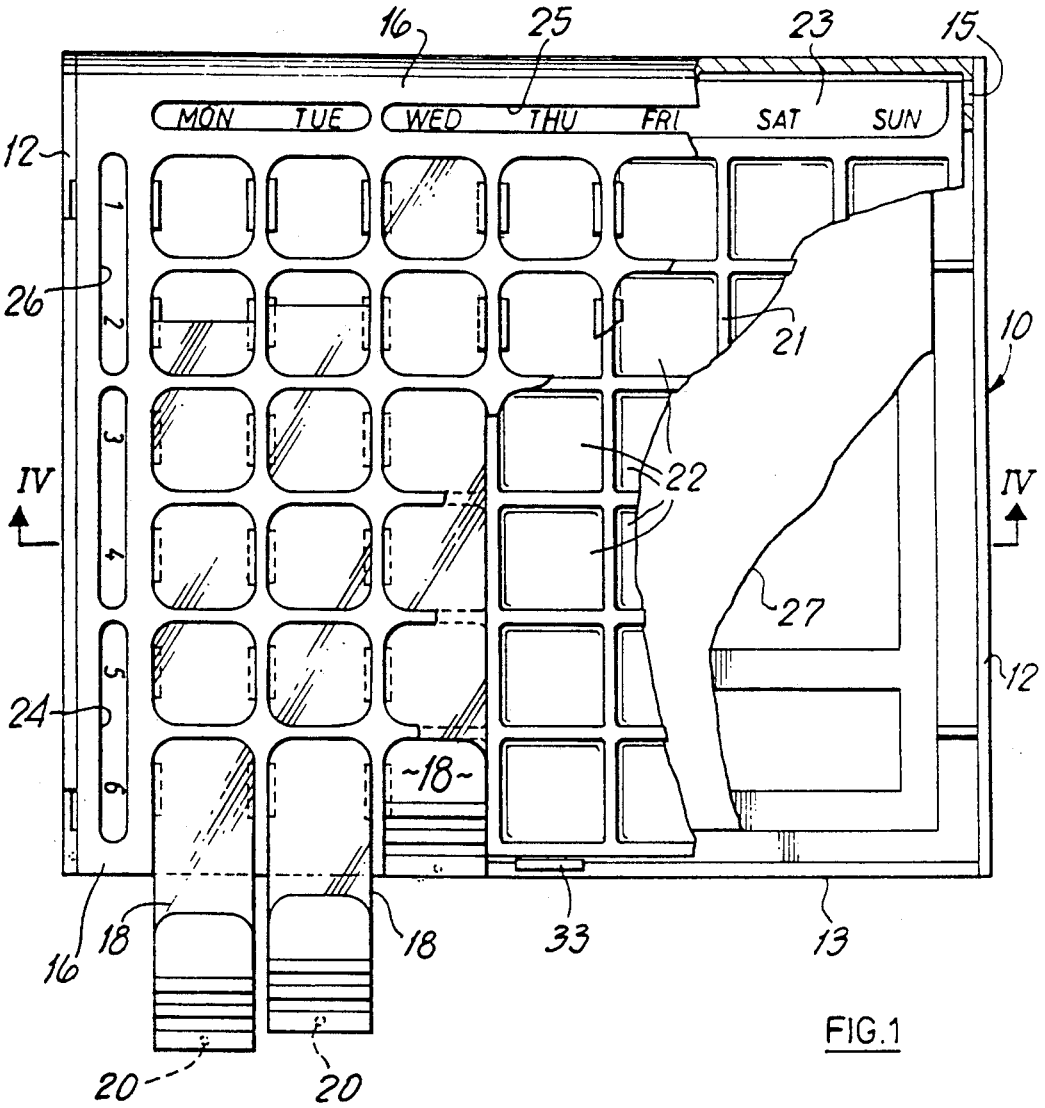
FIG. 1 is a plan view of a container made in accordance with the invention.
Figure 4:
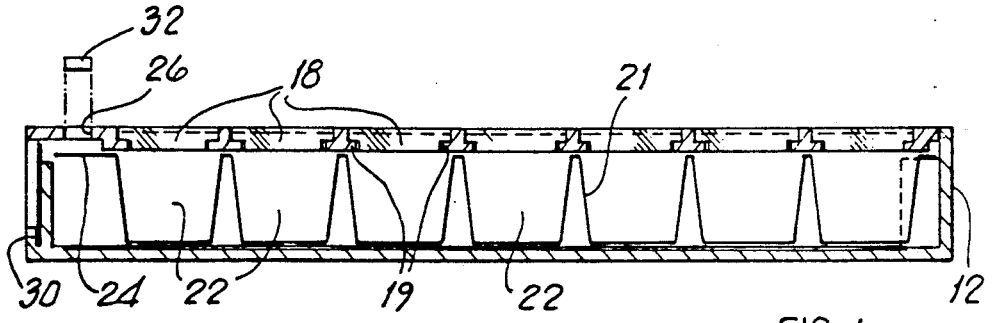
FIG. 4 is a vertical cross-section taken along IV—IV of FIG. 1.

A container for dispensing pills, tablets or capsules, made in accordance with the invention comprises a box 10 having a base 11 and side and front walls 12 and 13 respectively and a rear wall 14.

Hingedly attached at 15 to the rear of side walls 12 is a lid 16 which when closed covers the interior of the box. The lid 16 includes rows of windows 17 through which the interior or the box is visible, and in the example shown there are 7 rows representing the days of the week and each containing 6 separate windows representing 6 periods of each day.

Slidably located beneath the windows of each of the 7 rows is a transparent sliding shutter 18 supported beneath the underside of the lid 16 by shelf supports 19 formed integrally with the lid. Click stops 20 or similar catch devices are provided such that the shutters 18 may be slid open incrementally to expose one or more of the 6 windows in each daily row and to prevent the shutters from being easily removed entirely from the lid.

As may be seen from the cutaway illustration in FIG. 1, the box 10 contains a removable tray 21 which is formed to provide a plurality of compartments 22 each beneath one of the windows 17 in the lid when closed. Two edge regions of the tray 21 include ledges 23 and 24 to which may be adhered printed strips of paper on which the days of the week and either a series of numbers or times of the day, respectively are visible. For this purpose, slots 25 and 26 respectively are provided in the lid 16 so that when it is closed the printed material is visible through the slots.

Figure 3:
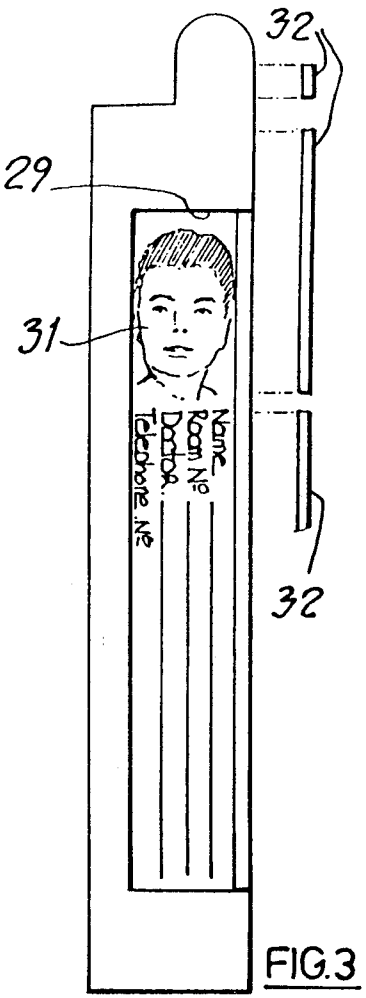
FIG. 3 is a view of one end.
Figure 2:
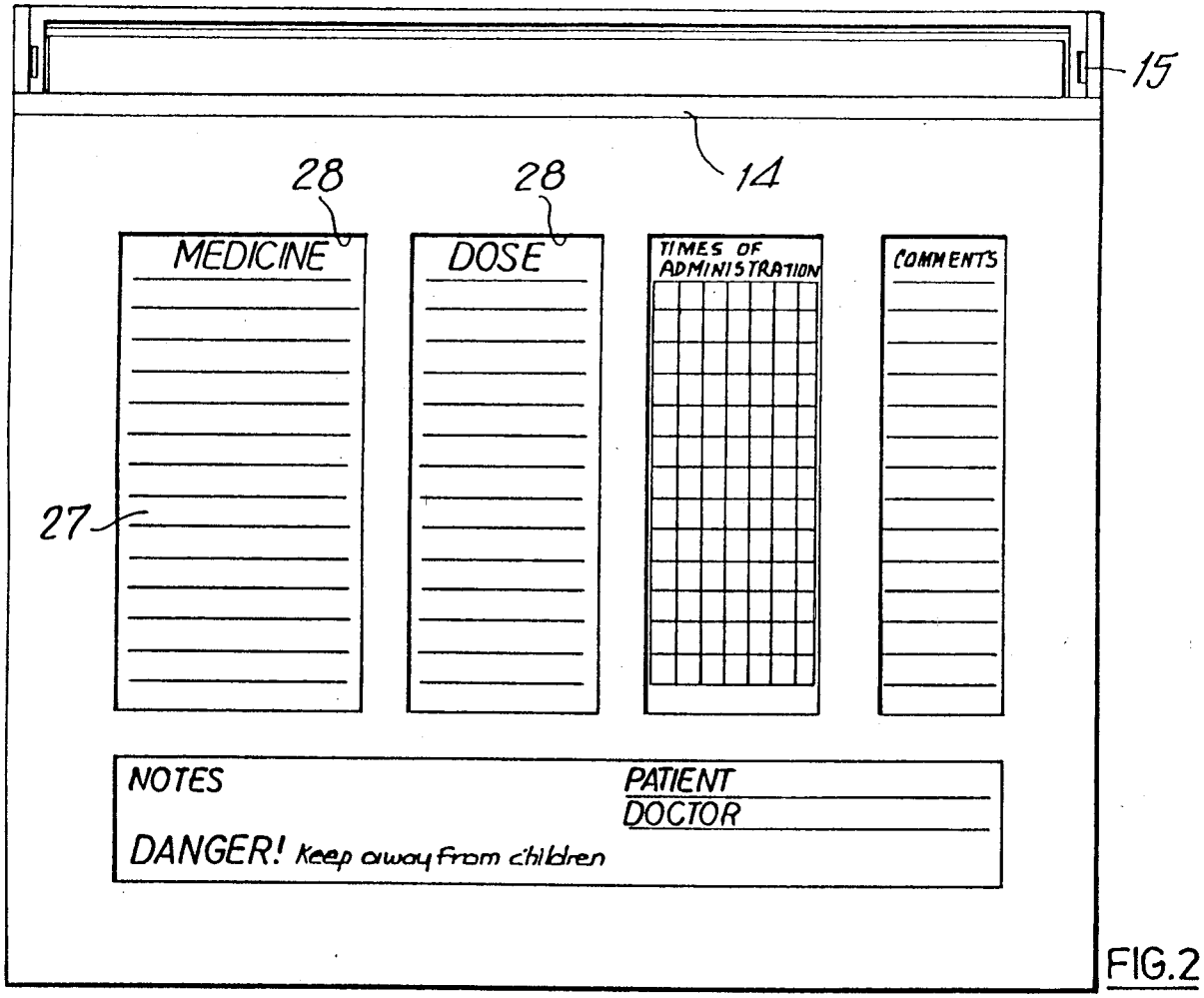
FIG. 2 is an underneath view.

Referring now to FIGS. 2 and 3, a card 27 is placed in the bottom of the box 10 beneath the tray 21 and contains printed material which is visible through cutouts or windows 28 in the bottom 11 of the box. The printed material may provide information, for example, of the patient's name, his doctor and the medicines, dosages and times of administration appropriate to that patient. The card 27 is loosely located in a recessed portion of the bottom 11 of the box and may be readily replaced by first removing the tray 21, but it is otherwise held captive therein by the tray. Therefore by turning the box over the printed material may be easily read.

In one end wall 12 of the box there is provided a further window 29 and a slot 30 to contain a further label on which the patient's details may be printed and perhaps containing a photograph of the patient as illustrated at 31 so that basic information concerning the patient may be viewed from the side of the container when a number of such containers are stacked together.

Slots 25 and 26 may be closed by replaceable plugs 32 (see FIG. 3) so that the information otherwise visible beneath the slots may be interchangeable. In this way alternative information may be provided without changing the information printed on the sides of the tray 21. For example, information in different languages or in braille may be provided on the device for specialised use.

A catch 33 is provided at the front of the box whereby the lid may be normally retained in the closed position but it will be seen that when the lid is opened, all of the compartments within the tray 21 may be exposed simultaneously for filling without the tray being removed from the box containing the patient's details.

This avoids the likelihood of incorrect medicines being dispensed to patients.

When required, with the lid hinged open the entire tray 21 may be withdrawn from the box for cleansing or replacement, and so the card 27 may be replaced or updated after removal of the tray.

The other card may be removed from slot 29 in the side wall 12 of the box once the lid is hinged open.

The box and lid are preferably made from a rigid plastics material and the shutters 18 from a transparent plastics material, whilst the tray 21 is preferably vacuum formed from a semi-rigid lightweight plastics so as to be inexpensively replaceable when worn or broken. The cards carrying patient information may be of paper and thus replaceable when amendment is required, or alternatively of a so-called wipe-clean plastics which may be written upon using an indelible pen.

It is not intended to limit the invention to the above example only. For example, shutters 18 may be other than transparent, the numbers and sizes of the windows in the lid and the compartments in the tray may be different from those illustrated and described, and the patient information to be provided on the underside of the container may be written in indelible ink on a panel of wipe-clean material.

The tray 21 may be in the form of compartmental walls integrally formed within the box.

The plugs 32 which are interchangeable to provide different information may also be colour-coded for identification.

The lid 16 may be slidable or fully removable with respect to the box to expose the compartments of the tray, provided that the tray need not be removed from that part of the box or lid containing the patient information.

I claim:

1. A container for dispensing pills, tablets, or capsules or combinations thereof, comprising a box with a lid, means visible on the box for displaying information appertaining to the intended contents, a compartmented tray within the box and having a plurality of rows of compartments to contain the pills or tablets to be taken at predetermined intervals, the lid including a plurality of windows each coinciding in superimposed relationship with one or more of said compartments with the lid closed, and with shutters to occlude the windows which may be opened selectively to permit the contents of one or more compartments to be discharged without opening the lid, all of the compartments of the tray being exposed for filling within the box when the lid is opened without separation of the tray from the information displaying means, and further including at least one window which is provided in the bottom of the box, and including a removable information card which is visible through said bottom window.

2. A container according to claim 1, wherein the compartmented tray is a removable item positioned within the box.

3. A container according to claim 1 or claim 2, wherein the compartmented tray includes edge regions on which is marked information such as the days of the week and times of each day in alignment with various of the compartments, and further including additional windows or apertures in the lid, through which said information marked on the edge regions is visible.

4. A container according to claim 3, wherein said additional windows or apertures are adapted to receive removable plugs which occlude said additional apertures or windows and on which replacement information may be marked.

5. A container according to claim 1, wherein the shutters comprise a plurality of strips of transparent material slidably located on the lid, one above each row of compartments, and supported so as to be movable progressively to occlude or expose individual compartments of a row thereof in said tray.

6. A container according to claim 5, including catch devices whereby the shutters may be slid open incrementally to expose one or more of the windows in each row and to prevent the shutters from being easily removed entirely from the lid.

7. A container according to claim 1, wherein each shutter is supported beneath the underside of the lid by shelf supports formed integrally with the lid.

8. A container according to claim 1, in which one side wall of the box is provided with a further window or aperture and a slot to contain a card carrying further information and visible through the further window or aperture when the lid is closed.

9. A container according to claim 1, wherein the lid is hingedly attached to the box and contains seven rows of said windows representing the days of the week, each row containing six separate windows representing six periods of each day.

10. A container according to claim 1, including a catch between the lid and the box whereby the lid may be normally retained in a closed position.

11. A container according to claim 1, wherein the box and lid are made from a rigid plastics material, the shutters are made from a transparent plastics material and the compartmented tray is vacuum formed from a semi-rigid lightweight plastics thus to be inexpensively replaceable when worn or broken.

* * * * *